US005833350A

United States Patent [19]

Moreland

[11] Patent Number: 5,833,350

[45] Date of Patent: Nov. 10, 1998

[54] SWITCH COVER PLATE PROVIDING AUTOMATIC EMERGENCY LIGHTING

[75] Inventor: Gregory B. Moreland, Mission Hills, Calif.

[73] Assignee: Electro Static Solutions, LLC, Irvine, Calif.

[21] Appl. No.: 846,041

[22] Filed: Apr. 25, 1997

[51] Int. Cl.[6] ..... F21V 33/00

[52] U.S. Cl. ..... 362/95; 362/20; 200/312; 200/317

[58] Field of Search ..... 200/312, 317; 307/66; 315/76, 86, 87; 340/815.62; 362/20, 85, 95, 276, 802

[56] References Cited

U.S. PATENT DOCUMENTS

| | | | |
|---|---|---|---|
| 3,739,226 | 6/1973 | Seiter et al. | 362/20 |
| 4,177,500 | 12/1979 | Nichdl et al. | 362/20 |
| 4,461,974 | 7/1984 | Chiu | 315/65 |
| 4,514,789 | 4/1985 | Jester | 362/95 |
| 4,631,649 | 12/1986 | McCue et al. | 362/183 |
| 4,749,908 | 6/1988 | Stifter | 315/86 |
| 4,977,351 | 12/1990 | Bavaro et al. | 315/87 |
| 5,132,596 | 7/1992 | Walters et al. | 315/159 |
| 5,336,977 | 8/1994 | Li | 315/159 |
| 5,473,517 | 12/1995 | Blackman | 362/95 |

*Primary Examiner*—Alan Cariaso
*Attorney, Agent, or Firm*—Gene Scott-Patent Law & Venture Group

[57] ABSTRACT

A wall switch cover plate conceals an electrical circuit capable of sensing the field provided by the covered switch circuit. When power is lost at the switch circuit the electrical circuit senses the loss of power and activates one or more LEDs to provide emergency illumination. The electrical circuit is self contained and does not require stand-by energy so that the batteries are long lasting.

7 Claims, 2 Drawing Sheets

SWITCH COVER PLATE PROVIDING AUTOMATIC EMERGENCY LIGHTING

BACKGROUND OF THE INVENTION

FIELD OF THE INVENTION

This invention relates generally to emergency lighting devices such as standby automatic lamps, and more particularly to such an emergency lighting device assembled into a common switch cover plate and providing an illumination source and a sensor for determining when AC power has been lost to the electrical switch covered by the plate.

DESCRIPTION OF RELATED ART

The following art defines the present state of this field:

Nicholl et al., U.S. Pat. No. 4,177,500 describes a power failure light for monitoring a power line and for illumination upon the interruption of power. This invention includes a light bulb, a rechargeable battery, a power supply providing charging current for the battery, a pair of diodes connecting the battery across the power supply, a pair of cascaded transistors connecting the bulb across the battery with base-emitter junctions Chiu, U.S. Pat. No. 4,461,974 describes a multiple lamp system for use with fiber optic light guide for automatically switching from a main lamp to a standby lamp, upon failure of the former. A solenoid is employed with the inductor in the circuit of the main lamp to overcome the bias of the switch in the standby lamp circuit to keep the former open. When the main lamp fails causing the interruption of current flow, the switch closes thereby permitting energization of the standby lamp. An indicator is provided to show which lamp is functioning.

Jester, U.S. Pat. No. 4,514,789 describes a light switch plate having a rearwardly opening housing for removably holding an AA battery. This invention is detachably mountable over a conventional wall mounted 110 volt AC light switch. An LED mounted on the front of the housing is connected to the battery through an integrated circuit oscillator, which flashes the LED.

McCue et al., U.S. Pat. No. 4,631,649 describes an emergency light fixture that is permanently mountable in a conventional power outlet box having, in fixed relation, a threaded bore for accommodating a screw for a face plate and slots for accommodating an electric plug. The emergency light fixture includes a housing, an electric plug extending from the rear wall of the housing, a battery, a battery charger, and a lamp mounted in the housing and wired to provide illumination during a power outage.

Bavaro et al., U.S. Pat. No. 4,977,351 describes an emergency lighting system which permits at least one gas discharge lamp to be operated from an AC power source when AC current is present and form a battery when AC signal is not present. The circuit also provides the capability for turning the lamp on under other selected emergency conditions such as in response to an intruder detection, or in response to detection of smoke, heat, water, or some other emergency.

Walters et al., U.S. Pat. No. 5,132,596 describes an outdoor lighting control that includes a photosensor responsive to ambient outdoor light and an alternating current relay with a pair of contacts movable between make and break positions. The relay includes a contact actuating arrangement that responds to the photosensor and alternating current bias the contact into a make position and move the contacts electromagnetically into a break position. The contact actuating arrangement is sufficiently stiff and responsive to the alternating current to limit chatter in the contact during passage from make to break to fifteen milliseconds when the photosensor senses a transition between dark and daylight. Preferably, the chatter is limited between 1 and 10 milliseconds.

Li, U.S. Pat. No. 5,336,977 describes an emergency lighting device that includes a hollow casing, a magnetic field detecting unit, a lamp unit and a driving unit. The casing is positioned adjacent to an electric outlet. The magnetic field detecting unit is disposed inside the casing and detects the absence of a magnetic field from the electric outlet. The lamp unit is mounted operatively on the casing. The driving unit is disposed inside the casing and is connected electrically to the lamp unit and to the detecting unit. The driving unit includes a light-sensitive switch unit and is responsive to the detecting unit so as to activated the lamp unit only when the magnetic field from the electric outlet is absent and there is weak surrounding light.

Blackman, U.S. Pat. No. 5,473,517 describes a housing for an emergency light source, which is electrically connectable to a conventional light switch. The housing replaces a conventional switch plate and has at least one opening for receiving the switch plate and has at least one opening for receiving the switch actuator of the light switch. The replacement housing includes wires for electrical connection to the light switch and is divided into upper and lower housing section, wherein the upper section includes a battery compartment, a printed circuit board compartment, and an opening to receive the switch actuator. The lower housing section includes a compartment for receiving a compact fluorescent lamp, reflectors, and a diffuser cover.

The prior art teaches a variety of safety and emergency lighting devices. Blackman teaches a replacement switchplate with wired connection to a light switch. This switch plate contains a lighting means. Walters teaches a lighting control having photosensor responsive means. Jester teaches a lighted switch plate. Li teaches a magnetic field sensor responsive to an absence of power at a nearby AC outlet, such a sensor being unable to operate in conjunction with a switch since without current flow a magnetic field is not produced. However, the prior art does not teach a switch plate of compact size and proportions having field sensing capability so as to avoid the necessity of hard wiring and which provides an exit marker and illumination. The present invention fulfills these needs and provides further related advantages as described in the following summary.

SUMMARY OF THE INVENTION

The present invention teaches certain benefits in construction and use which give rise to the objectives described below.

The present invention provides a wall switch cover plate which includes an electrical circuit capable of sensing the electrostatic field associated with the adjacent wall switch circuit. The electrical circuit uses an antenna for sensing the loss of field energy and then makes a lighting circuit in order to provide emergency exit lighting.

A primary objective of the present invention is to provide a proximity circuit capable of providing emergency lighting when a power failure occurs, such circuit having advantages not taught by the prior art.

Another objective is provide such a circuit within a switch plate that is mounted over a switch box by the typical screw-on method used for common switch plates.

A further objective is to provide such a circuit which has the advantage of being operated over long periods of time by a small battery source and therefore does not require the use of household current.

A still further objective is to provide such a switch plate embodied in a relatively flat and compact size so as to give the appearance of an ordinary switch plate, yet which provides the advantages of emergency lighting and automatic functioning upon power failure.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

The above described drawing figures illustrate the invention, an emergency lighting device for covering a wall switch electrical box 10, which is mounted in a wall 20. The electrical box 10 contains an electrical wall switch 30 having a switch arm 32 extending outwardly from the wall 20 so as to be easily moved for turning room lights, for instance, on or off.

Figure 1:
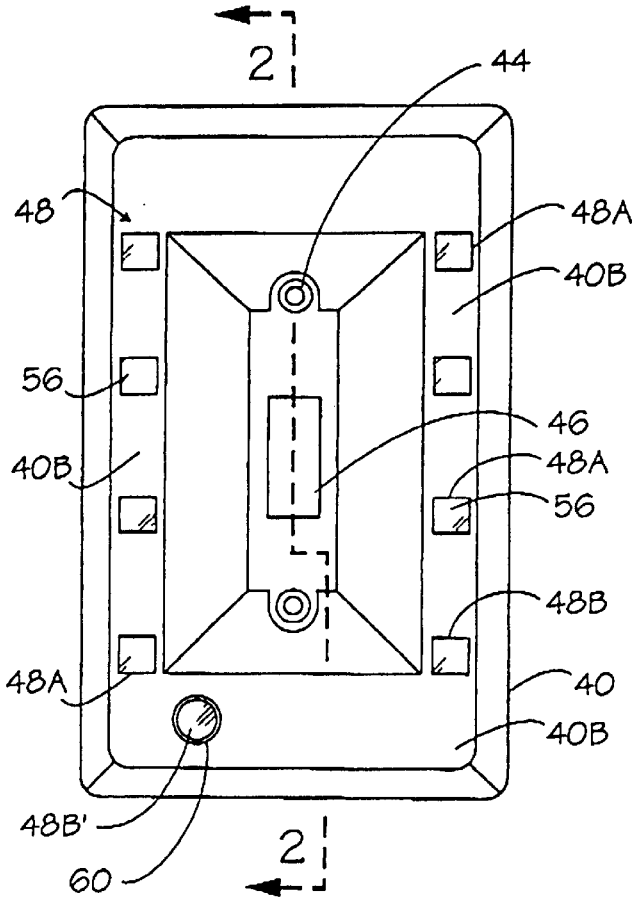
FIG. 1 is a front elevational view of the present invention.
Figure 2:
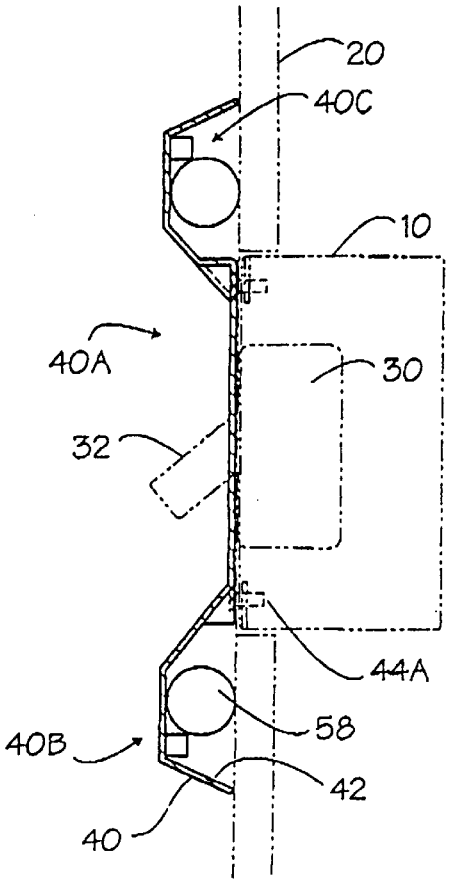
FIG. 2 is a sectional side elevational view thereof taken along cutting line 2—2 in FIG. 1 and showing a switch box and wall switch.

The invention includes a switch plate 40, best illustrated in FIGS. 1 and 2, for covering the wall switch electrical box 10, the switch plate providing an electrical circuit mounting means 42, a switch plate mounting means 44 typically a pair of spaced apart holes, and a switch arm engaging means 46, typically a rectangular hole. Preferably, the switch plate 40 is rectangular in shape and provides a central portion 40A including the switch plate mounting means 44 and the switch arm engaging means 46. The central portion 40A is contoured to lie in contact with the wall switch 30. The switch plate 40 further includes a peripheral portion 40B providing an enclosure means 40C for enclosing an electrical circuit 50. The enclosure means 40C provides a space for containing the components of the electrical circuit 50. This space is enclosed between the wall 20 and the switch plate 40 so that the electrical circuit components and supporting elements are not visible from the front of the switch plate 40. The central portion 40A in its physical cooperation with the wall switch 30, and the peripheral portion 40B in cooperation with the central portion and the surrounding wall is considered a key inventive aspect of the present invention in that the device, as a whole takes on the appearance of a simple, common wall switch cover, and provides, a close-to-the wall portion (40A) for engaging the switch arm 32 (also commonly referred to as a "bat" or "toggle"), and a peripheral enclosure portion (40B) which takes on an aesthetic appearance while providing a means for circuit housing within the electrostatic filed of the switch.

Figure 3:
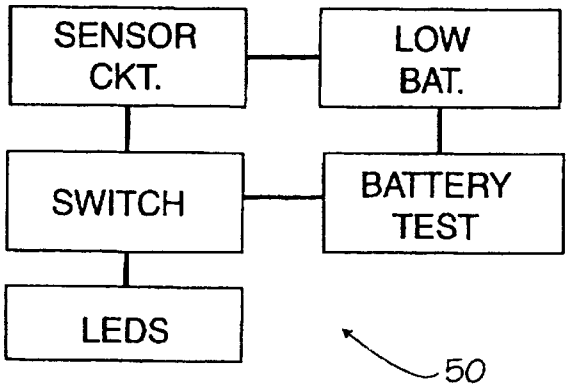
FIG. 3 is an overall block diagram of an electrical circuit of the invention.
Figure 4:
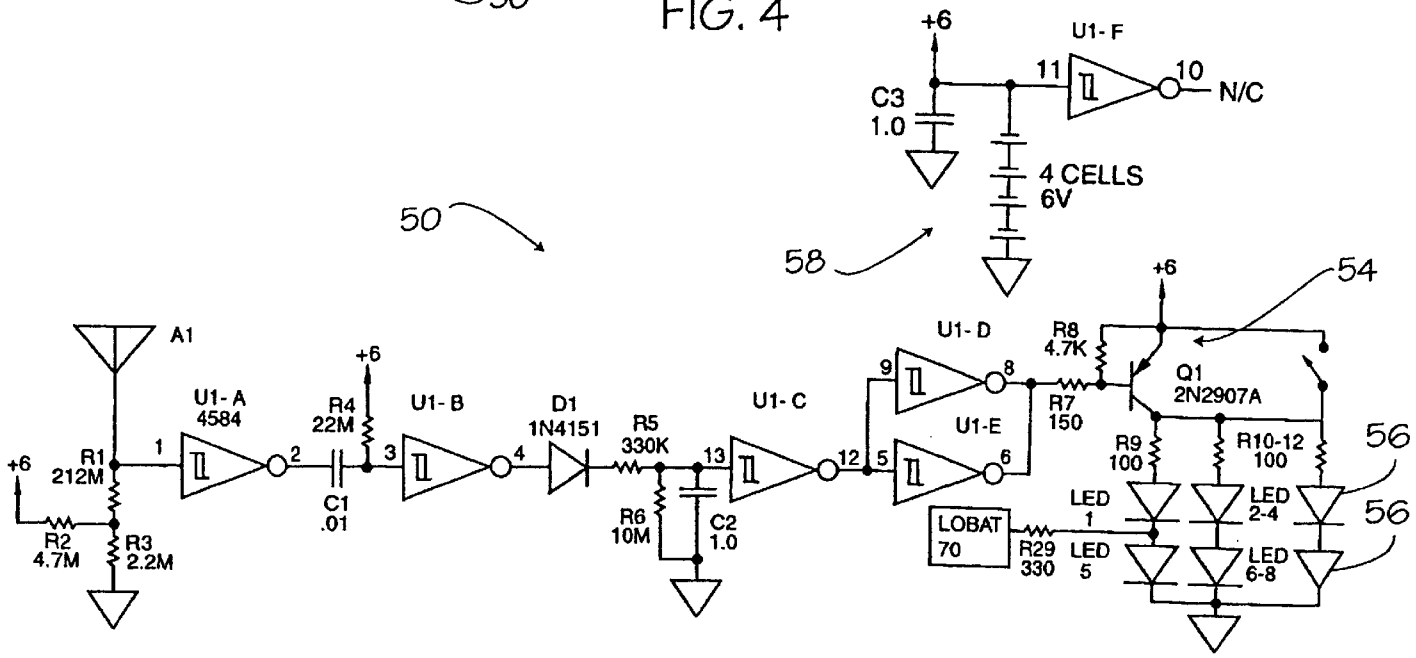
FIG. 4 is a detailed electrical schematic diagram of the electrical circuit of the invention.

The electrical circuit 50, best illustrated in FIGS. 3 and 4, comprises an electrostatic field sensing means 52. In this case an antenna is used to sense a changing electrostatic field generated in the space surrounding a wall switch. This is based upon the fact that an open switch that is interconnected with a source of AC voltage maintains a voltage across its contacts. Such a voltage has associated with it an electrostatic field, which is, in fact, the source of the voltage differential. Because the voltage is varying, the field is built-up and then collapses regularly with the varying voltage differential. An antenna is able to detect such a varying electrostatic field because each time the field collapses a spike of energy is transmitted into space by the switch contacts. This is normally heard on a radio receiver as noise or static. The use of an antenna for the present purpose is considered a key inventive aspect of the present invention. The circuit further includes an emergency switching means 54, an illumination means 56 and a power source means 58. The electrical circuit 50 is engaged by the electrical circuit mounting means 42 so that the electrical circuit 50 is covered from view when the switch plate 40 is mounted to the wall 20 by the switch plate mounting means 44, typically taking two screws 44A. An antenna A1 picks up an AC signal generated by the electrostatic field associated with the AC voltage at the electrical wall switch 30, which is in proximity to the antenna A1. As seen in FIG. 4, this signal is DC coupled to a logic buffer at U1-1 operating as a semi-linear first amplifier stage. R2 and R3 establish a bias level which is fed to the first amplifier stage through a very large value resistor R1. R1 allows the input impedance of the first amplifier stage to be very high so that the antenna Al does not have to be tightly coupled to the source of the signal. The bias makes the input stage more sensitive so that a small antenna can be used, in this case a short wire.

The output of the first stage at U1-2 is AC coupled to the second stage at U1-3 via C1. The second stage is biased by R4 so that the output at U1-4 is low, near ground, when there is a lack of signal from the input first stage.

The output of the second stage at U1-4 is rectified and filtered by the combination of D1, R5, R6, and C2. R5 limits the charging time of the capacitor C2 when the antenna A1 senses an AC signal. R6 discharges C2 slowly in the absence of the AC signal. The charge and discharge time constants prevent the circuit from false tripping on noise signals and produce a desired sluggish and clean signal response.

The output of the rectifier section is fed to the first of the output drivers at U1-13. This driver switches its output, at U1-12, low when AC signals are present at the antenna A1, and high, near the battery voltage, when the AC signal is absent. The output of this first output driver, at U1-12, drives two more drivers, at U1-5 and at U1-9 in parallel.

The output of the two parallel drivers, at U1-8 and U1-6, drives the switch transistor, Q1. Two drivers in parallel are used to guarantee that Q1 will be turned on very hard and therefore Q1 will have the lowest possible loss of available power.

The switch Q1 turns on the illumination means 56, preferably an array of up to 8 high intensity light emitting diodes (LEDs). The array preferably consists of 4, near identical, pairs of LEDs. Each pair includes a resistor R9–R12 in series with two of the LEDs as shown in FIG. 4. The resistors function to limit current to the LEDs. This current limiting resistor arrangement sets the maximum LED current when the batteries are fresh. Therefore battery life is maximized. One of the 4 pairs of LEDs has a pickoff through a limiting resistor, R29. This pickoff may be used for indicating a low battery warning indication. Such a warning indication circuit 70 is well known in the art so that it is not further described here. U1 is shown as U1A to U1-F to illustrate the various portions of this integrated circuit U1 and their functions.

The switch plate 40 further provides an illumination means viewing means 48. The illumination means viewing means 48 may include at least one aperture 48A in the switch plate 40, the aperture(s) 48A being positioned and engaged with the illumination means 56 for direct viewing of the illumination means 56. Therefore, as shown in FIG. 1, aperture 48A is one or more rectangular holes in switch plate 40 through which elements of illumination means 56 may protrude. Alternately, the illumination means viewing means 48 may include at least one light transmissive portion 48B on the switch plate 40, where, the at least one light transmissive portion 48B is positioned and engaged with at least one element of the illumination means 56 for indirect viewing of the illumination means 56, i.e., by viewing the light from the illumination means 56 without viewing the illumination means 56 itself. Such an alternate viewing means 48B may be a clear or a colored portion of switch plate 40 which, as shown in FIG. 1 may lay over an illumination element part of illumination means 56.

The emergency switching means 54 interconnects the power source means 58 with the illumination means 56 when the field sensing means 52 fails to sense an electrostatic field so as to provide emergency illumination when power is lost at the electrical wall switch 30.

The invention preferably further including a test switch 60 interconnected with the electrical circuit 50 for testing the circuit 50 by closing the electrical circuit 50 manually.

Further, the electrical circuit 50 further preferably includes a low-battery sensor 70 interconnected with the electrical circuit 50 for sensing a low battery condition and for lighting the illumination means 56, i.e., LED 5, for indicating a low battery condition.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An emergency lighting device for covering a wall switch electrical box mounted in a wall, the electrical box containing an electrical wall switch having a switch arm extending outwardly from the wall, the device comprising:

a switch plate for covering the wall switch electrical box, the switch plate including an electrical circuit mounting means, a switch plate mounting means and a switch arm engaging means;

an electrical circuit comprising a varying electrostatic field sensing means, an emergency switching means, an illumination means and a power source means, the electrical circuit being engaged by the electrical circuit mounting means so that the electrical circuit is covered from view when the switch plate is mounted to the wall by the switch plate mounting means;

the switch plate further providing illumination means viewing means; the emergency switching means interconnecting the power source means with the illumination means when the field sensing means fails to sense a varying electrostatic field so as to provide emergency illumination when power is lost at the electrical wall switch.

2. The device of claim 1 wherein the illumination means viewing means includes at least one open portion of the switch plate, the at least one open portion being positioned and engaged with the illumination means for direct viewing of the illumination means.

3. The device of claim 1 wherein the illumination means viewing means includes at least one light transmissive portion of the switch plate, the at least one light transmissive portion being positioned and engaged with the illumination means for indirect viewing of the illumination means.

4. The device of claim 1 wherein the switch plate is rectangular in shape and provides a central portion including the switch plate mounting means and the switch arm engaging means, and a peripheral portion providing an enclosure means for enclosing the electrical circuit.

5. The device of claim 1 further including a test switch interconnected with the electrical circuit for testing the circuit and for opening the electrical circuit manually.

6. The device of claim 1 further including a low-battery sensor interconnected with the electrical circuit for sensing a low battery condition and for lighting the illumination means for indicating a low battery condition.

7. The device of claim 1 wherein the electrostatic field sensing means is an antenna, the emergency switching means is a transistor driven by an amplified signal provided by the antenna, the illumination means is a plurality of LED devices, and the power source means is a battery.

* * * * *